US009890794B2

(12) United States Patent
Gu et al.

(10) Patent No.: US 9,890,794 B2
(45) Date of Patent: Feb. 13, 2018

(54) FAN ASSEMBLY

(71) Applicant: ScienBiziP Consulting (Shenzhen) Co., Ltd, Shenzhen (CN)

(72) Inventors: Hui-Ying Gu, Foshan (CN); Hsien-Chou Lin, New Taipei (TW); Chih-Feng Hu, New Taipei (TW); Yung-Ping Lin, New Taipei (TW)

(73) Assignee: ScienBiziP Consulting(Shenzhen)Co., Ltd., Shenzhen (CN)

( * ) Notice: Subject to any disclaimer, the term of this patent is extended or adjusted under 35 U.S.C. 154(b) by 196 days.

(21) Appl. No.: 14/806,860

(22) Filed: Jul. 23, 2015

(65) Prior Publication Data

US 2016/0146221 A1 May 26, 2016

(30) Foreign Application Priority Data

Nov. 25, 2014 (CN) ..... 2014 1 0684081

(51) Int. Cl.
*F04D 29/52* (2006.01)
*F04D 19/00* (2006.01)
*F04D 29/64* (2006.01)

(52) U.S. Cl.
CPC ..... *F04D 29/522* (2013.01); *F04D 19/007* (2013.01); *F04D 29/646* (2013.01)

(58) Field of Classification Search
CPC ..... F04D 19/007; F04D 3/005; F04D 13/14; F04D 25/08; F04D 25/166; F04D 29/522; F04D 29/60; F04D 29/601; F04D 29/64; F04D 29/644; F04D 29/646
See application file for complete search history.

(56) References Cited

U.S. PATENT DOCUMENTS 7,156,611 B2 * 1/2007 Oosawa ..... F04D 19/007 415/199.5
7,585,150 B2 * 9/2009 Hsu ..... H05K 7/20172 415/213.1
8,177,486 B2 * 5/2012 Lee ..... H05K 7/20172 415/213.1
2007/0059155 A1 * 3/2007 Ishihara ..... F04D 19/007 415/60
2008/0286135 A1 * 11/2008 Yoshida ..... F04D 19/007 417/423.5
2009/0111372 A1 * 4/2009 Hsu ..... F04D 19/007 454/190

(Continued)

FOREIGN PATENT DOCUMENTS

TW M435152 A 8/2012

*Primary Examiner* — Woody Lee, Jr.
*Assistant Examiner* — Sang K Kim
(74) *Attorney, Agent, or Firm* — ScienBiziP, P.C.

(57) ABSTRACT

A fan assembly includes a first fan including a first frame, a second fan including a second frame, the first frame of the first fan has a first jointing surface, and the second frame of the second fan has a second jointing surface. A first concave structure and a first flange are formed along two ends of a first direction of the first jointing surface of the first fan, and a first concave structure and a first flange are formed along two ends of a first direction of the second jointing surface of the second fan respectively. The first flange of the first fan moves relatively to the second jointing surface of the second fan, and is embedded in the first concave structure of the second fan.

6 Claims, 3 Drawing Sheets

(56) References Cited

U.S. PATENT DOCUMENTS

2010/0329860 A1* 12/2010 Li ..... F04D 19/007
415/213.1
2013/0004293 A1* 1/2013 Zhao ..... F04D 25/0613
415/66
2013/0126698 A1* 5/2013 Yin ..... G06F 1/20
248/674
2013/0189076 A1* 7/2013 Liu ..... F04D 29/522
415/68

* cited by examiner

FAN ASSEMBLY

CROSS-REFERENCE TO RELATED APPLICATIONS

This application claims priority to Chinese Patent Application No. 201410684081.1 filed on Nov. 25, 2014, the contents of which are incorporated by reference herein.

FIELD

The subject matter herein generally relates to a fan, especially relates to a fan assembly.

BACKGROUND

A fan assembly is used to cool electrical components of electrical device. In certain implementations, the fan assembly includes a first fan and a second fan attached to the first fan by a plurality of rivets. The combination of the first fan and the second fan can be such that fan assembly is shipped as a single unit.

BRIEF DESCRIPTION OF THE DRAWINGS

Implementations of the present technology will now be described, by way of example only, with reference to the attached figures.

DETAILED DESCRIPTION OF EMBODIMENTS

It will be appreciated that for simplicity and clarity of illustration, numerous specific details are set forth in order to provide a thorough understanding of the embodiments described herein. However, it will be understood by those of ordinary skill in the art that the embodiments described herein can be practiced without these specific details. In other instances, methods, procedures and components have not been described in detail so as not to obscure the related relevant feature being described. Also, the description is not to be considered as limiting the scope of the embodiments described herein. The drawings are not necessarily to scale and the proportions of certain parts have been exaggerated to better illustrate details and features of the present disclosure. The description is not to be considered as limiting the scope of the embodiments described herein.

The term "comprising" means "including, but not necessarily limited to"; it specifically indicates open-ended inclusion or membership in a so-described combination, group, series and the like.

Figure 1:
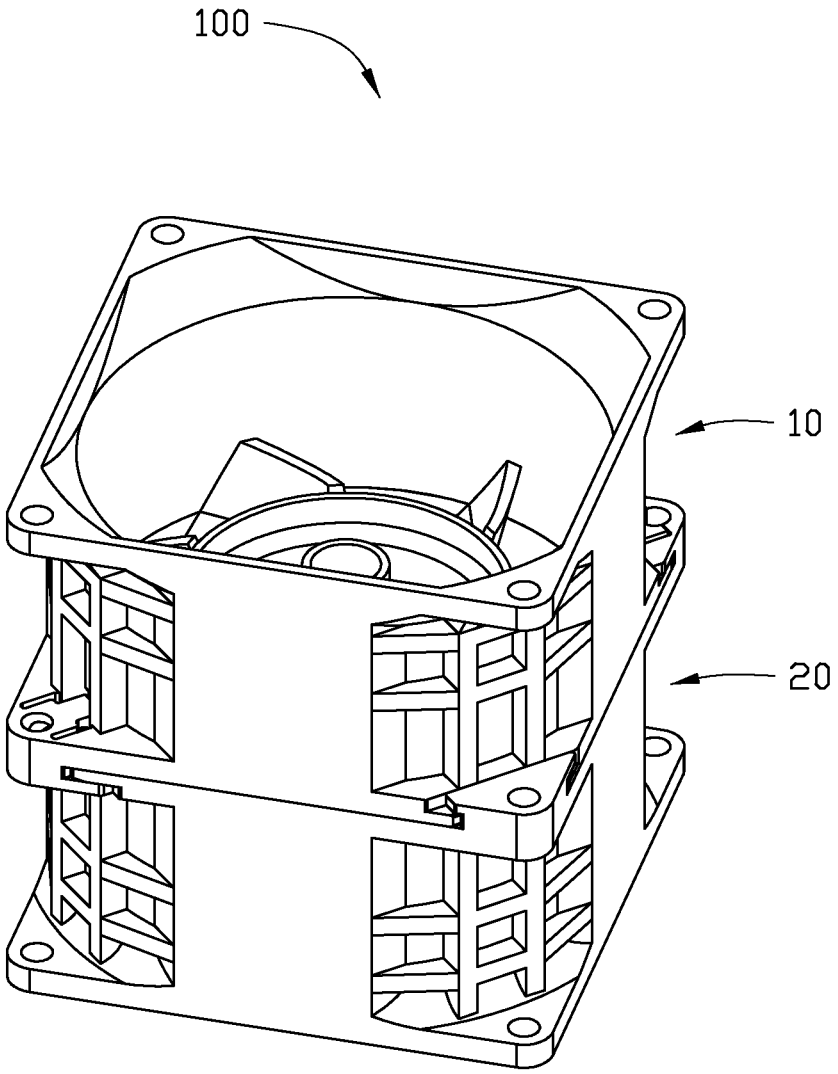
FIG. 1 is an isometric, assembly view of a fan assembly of an embodiment of the present disclosure.

Referring to FIG. 1, a fan assembly 100 of a embodiment of the present disclosure includes a first fan 10 and a second fan 20. The first fan 10 is attached on the second fan 20 to combine a fan 100 to cool electrical components of electrical device.

Figure 2:
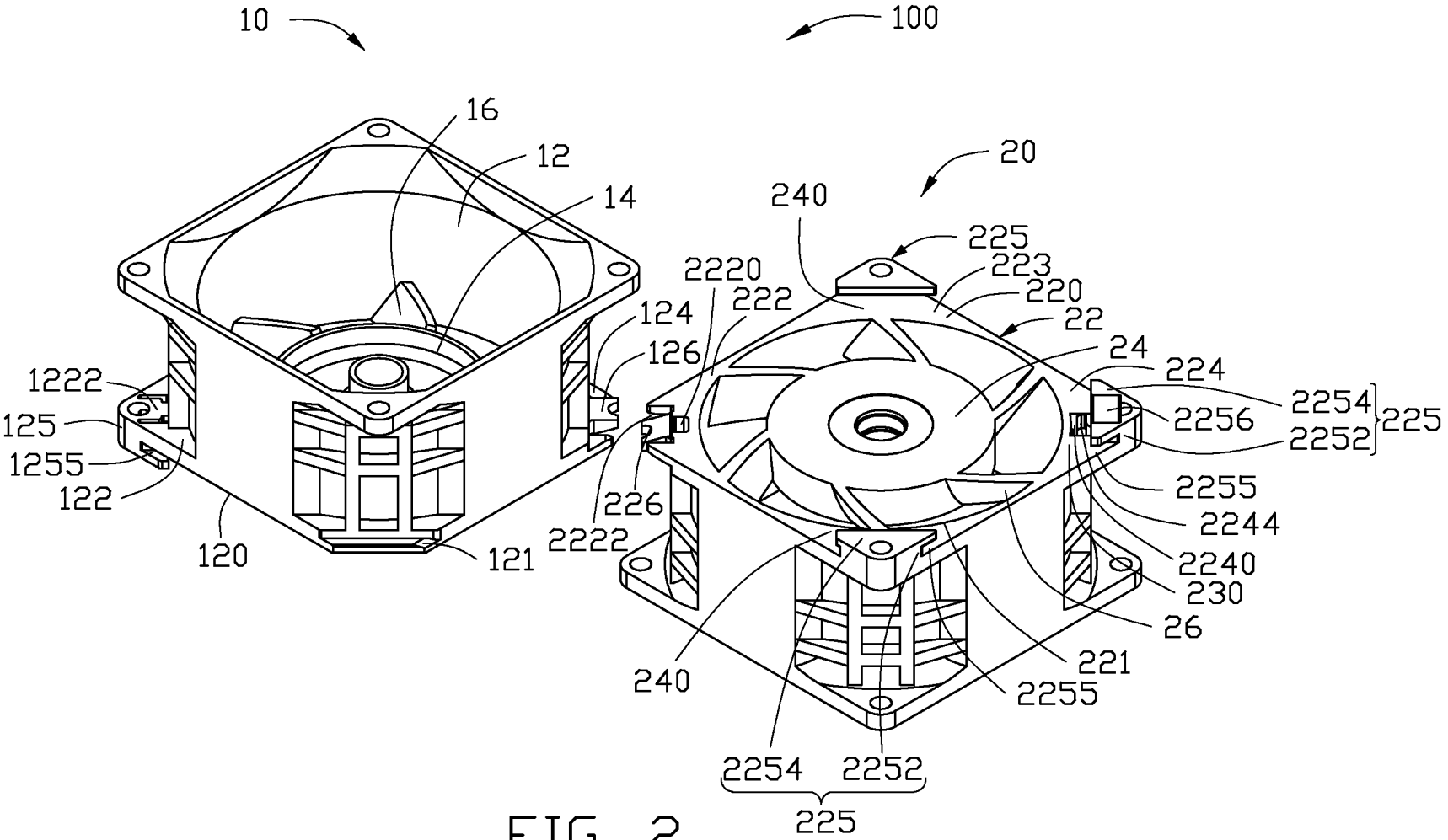
FIG. 2 is an exploded, isometric view of the fan assembly of FIG. 1.

Also referring to FIG. 2, the first fan 10 includes a first frame 12, and the second fan 20 includes a second frame 22. The first frame 12 has a first jointing surface 120, and a second frame 22 has a second jointing surface 220.

In this embodiment, a first direction is defined along a diagonal direction of the first fan 10 and the second fan 20, a second direction is defined along another diagonal direction of the first fan 10 and the second fan 20.

Figure 3:
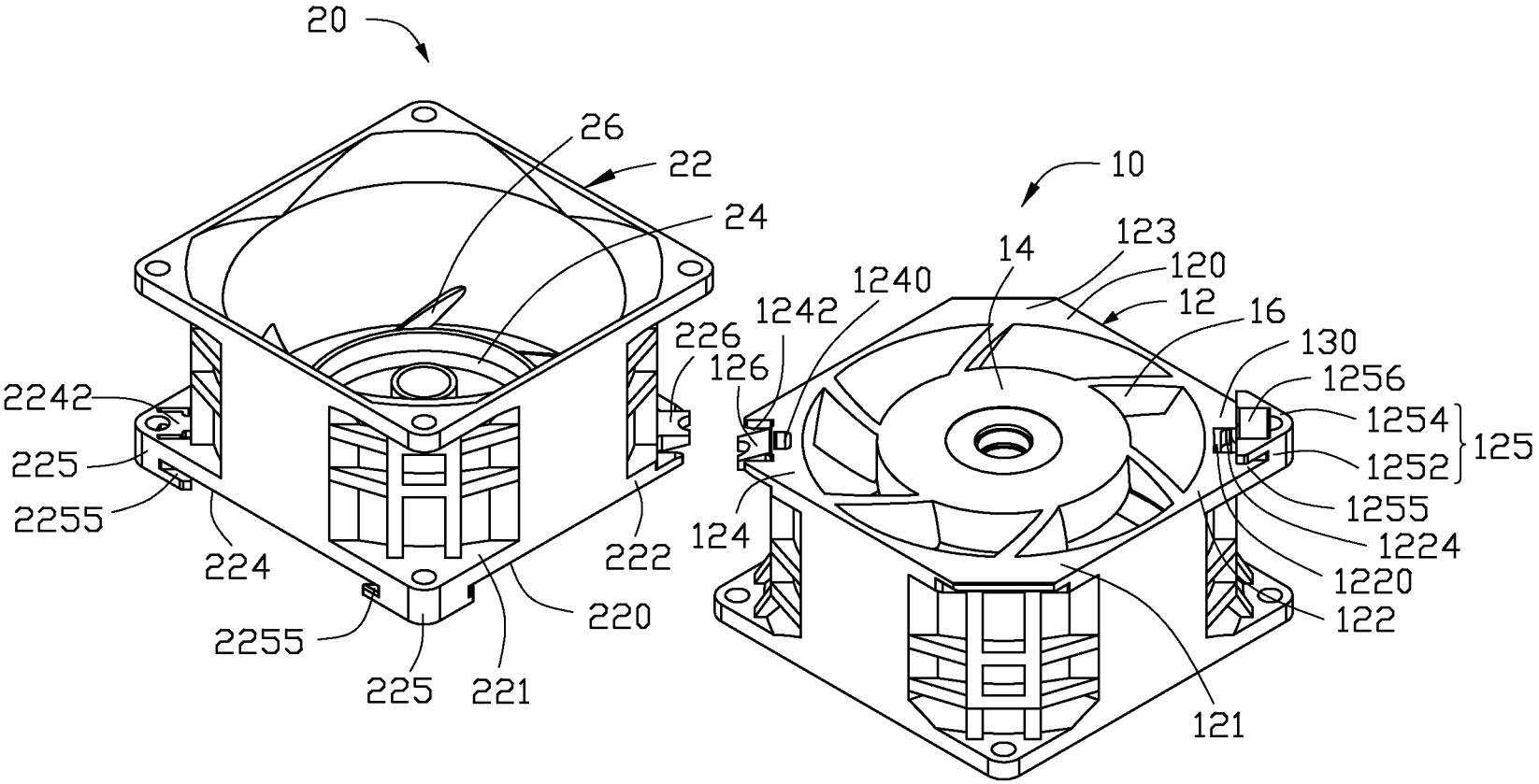
FIG. 3 is an exploded, isometric view of the fan assembly of FIG. 1, but show from another aspect.

Referring to FIG. 3, a first concave structure 130 and a first flange 124 are formed along two ends of the first direction of the first jointing surface 120 of the first fan 10. A first concave structure 230 and a first flange 222 are also formed along two ends of the first direction of the second jointing surface 220 of the second fan 20. The first flange 124 of the first fan 10 can move relatively to the second jointing surface 220 of the second fan 20 to embed in the concave structure of the second fan 20. The first flange 222 of the second fan 20 can move relatively to the first jointing surface 120 of the first fan 10 to embed in the concave structure of the first fan 10.

An elastic cantilever 1222 is formed on an end of the first direction of the first jointing surface 120 of the first fan 10. A buckle hole 1240 is defined at another end of the first direction of the first jointing surface 120 and located opposite with the elastic cantilever 1222. A distal end of the elastic cantilever 1222 forms a block 1224 protruded beyond of the first jointing surface 120.

An elastic cantilever 2242 is formed at an end of the first direction of the second jointing surface 220 of the second fan 20. A buckle hole 2220 is defined at another end of the first direction of the first jointing surface 220, and located opposite with the elastic cantilever 2242. A distal end of the elastic cantilever 2242 forms a block 2244 protruded beyond of the second jointing surface 220. The block 1224 of the elastic cantilever 1222 of the first fan 10 is received in the buckle hole 2220 of the second fan 20, and abut against the second fan 20. The block 2244 of the elastic cantilever 2242 of the second fan 20 is received in the buckle hole 1240 of the first fan 10, and abut against the first fan 10.

As illustrated in FIG. 2, the first fan 10 also includes a circular first fixing base 14 located at a center of the first frame 12 to fix an impeller thereon. The circular first fixing base 14 connects the first frame 12 by a plurality of connecting arms 16. A bottom surface of the circular first fixing base 14 is coplanar with the first jointing surface 120 of the first fan 10.

The second fan 20 includes a circular second fixing base 24 located at a center of the second frame 22 to fix an impeller thereon. The circular second fixing base 24 connects the second frame 22 of the second fan 20 by a plurality of connecting arms 26. A top surface of the circular second fixing base 24 is coplanar with the second jointing surface 220.

As illustrated in FIG. 3, the first flange 124, a second flange 121, a third flange 123, and a fourth flange 122 are formed on the first jointing surface 120 of the first frame 12 of the first fan 10. The fourth flange 122 and the first flange 124 are formed along two ends of the first direction of the first jointing surface 120, and a top surface of the fourth flange 122 and the first flange 124 are coplanar with the first jointing surface 120. The second flange 121 and the third flange 123 are formed along two ends of the second direction of the first jointing surface 120, and a top surface of the second flange 121 and the third flange 123 are coplanar with the first jointing surface 120. In the illustrated embodiment, the first jointing surface 120 of the first fan 10, and the second jointing surface 220 of the second fan 20 are rectangular.

Two second concave structures 240 are formed along two ends of the second direction of the second jointing surface 220 of the second fan 20. The first flange 222, a second flange 221, a third flange 223, and a fourth flange 224 are formed on a top surface of the second frame 22 of the second fan 20. A top surface of the first flange 222, the second flange 221, the third flange, 223, and the fourth flange 224 are coplanar with the second jointing surface 220 of the second frame 22. The first flange 222 and the fourth flange 224 are formed along two ends of the first direction of the second jointing surface 220 of the second frame 22, the second flange 221 and the third flange 223 are formed along two ends of the second direction of the second jointing surface 220 of the second frame 22.

A bottom surface of the flange 122 of the first fan 10 extends downward to form an engagement part 125. The first concave structure 130 of the first fan 10 includes the fourth flange 122 and the engagement part 125. The engagement part 125 includes a connecting portion 1252 extended from the bottom of the flange 122, a supporting portion 1254 extends horizontally from the connecting portion 1252. The supporting portion 1254 is parallel with the first jointing surface 120 of the first frame 12 of the first fan 10. A slot 1255 is defined between an inner side of the engagement part 125 and the fourth flange 122.

The supporting portion 1254 defines a first groove 1256. The first groove 1256 connects with the slot 1255. The fourth flange 122 defines a second groove 1220. The second groove 1220 is configured relatively with the first groove 1256 of the supporting portion 1254. The fourth flange 122 extends horizontally in the second groove 1220 to form the elastic cantilever 1222. The distal end of the elastic cantilever 1222 extends towards the engagement part 125 to form the block 1224. The block 1224 protrudes beyond the first jointing surface 120 of the first fan 10. Two relative sides of the elastic cantilever 1222 are spaced apart from the fourth flange 122 to increase elasticity of the elastic cantilever 1222.

The first flange 124 defines a gap 1242. The first flange 124 extends upward in the gap 1242 to form a convex block 126. Two relative sides of the convex block 126 are spaced with the first flange 124 to increase elasticity of the convex block 126. The first flange 124 is near to the convex block 126 to define the buckle hole 1240.

A top surface of the second flange 221, the third flange 223, and the fourth flange 224 of the second fan 20 extends upward to form three engagement parts 225. The second concave structure 240 of the second fan 20 includes the second flange 221, the third flange 223, and the corresponding engagement part 225. The first concave structure 230 of the second fan 20 includes the fourth flange 224 and the corresponding engagement part 225. The engagement part 225 includes a connecting portion 2252 respectively extending from the top surface of the second flange 221, the third flange 223, or the fourth flange 224, and a supporting portion 2254 extending horizontally from the connecting portion 2252. The supporting portion 2254 is parallel with the second jointing surface 220 of the second frame 22 of the second fan 20. A slot 2255 is defined between the inner side of the engagement part 225 and the supporting portion 2254.

The supporting portion 2254 defines a first groove 2256. The first groove 2256 is connected with the slot 2255. The flange 224 defines a second groove 2240. The second groove 2240 is configured relatively to the first groove 2256 of the supporting portion 2254. The fourth flange 224 extends horizontally in the second groove 2240 to form the elastic cantilever 2242. The distal end of the elastic cantilever 2242 extends towards the engagement part 225 to form the block 2244. The block 2244 is protruded beyond the second jointing surface 220 of the second fan 20. Two relative sides of the elastic cantilever 2242 are spaced with the fourth flange 224 to increase elasticity of the elastic cantilever 2242.

Further, the first flange 222 of the second fan 20 defines a gap 2222. The first flange 222 extends downward in the gap 2222 to form a convex block 226. Two relative sides of the convex block 226 are spaced apart from the flange 222 to increase elasticity of the convex block 226. The first flange 222 near to the convex block 226 to define the buckle hole 2220.

While the first fan 10 and the second fan 20 are assembled, the first jointing surface 120 of the first frame 12 of the first fan 10 moves relatively to the second jointing surface 220 of the second frame 22 of the second fan 20 along a diagonal direction of the second fan 20. The first flange 124, second flange 121, and the third flange 123 of the first fan 10 are embedded in the slot 2255 of the first concave structure 230, the second concave structure 240 of the second fan 20. Also, the first flange 222 of the second fan 20 is embedded in the slot 1255 of the concave structure of the first fan 10. So the first fan 10 hardly moves relatively to the second fan 20 from a direction of upward to a direction of downward. Before the first flange 124, the second flange 121, and the third flange 123 of the first fan 10 are embedded in the slot 2255 of the second fan 20, the elastic cantilever 2242 of the second fan 20 is pressed downward by the first jointing surface 120 of the first frame 12 of the first fan 10, and the elastic cantilever 1222 of the first fan 10 is also pressed upward by the second jointing surface 220 of the first frame 22 of the second fan 20. The first flange 124, the second flange 121, and a third flange 123 of the first fan 10 are embedded in the slot 2255 of the second fan 20, the elastic cantilever 2242 of the second fan 20 rebounds to fit the block 2244 in the buckle hole 1240 of the first fan 10, and the elastic cantilever 1222 of the first fan 10 rebounds to fit the block 1224 in the buckle hole 2220 such that the first fan 10 hardly moves relatively to the second fan 20 along a horizontal direction. Further, the convex block 126 of the first fan 10 is received in the first groove 2256 of the second fan 20, and the convex block 226 of the second fan 20 is received in the first groove 1256 of the first fan 10 such that the first fan 10 and the second fan 20 are assembled together conveniently, and the combination of the first fan 10 and the second fan 20 can save the cost of the rivets and decrease the assembling time.

The embodiments shown and described above are only examples. Many details are often found in the art such as the other features of fan assembly. Therefore, many such details are neither shown nor described. Even though numerous characteristics and advantages of the present technology have been set forth in the foregoing description, together with details of the structure and function of the present disclosure, the disclosure is illustrative only, and changes can be made in the detail, including in matters of shape, size and arrangement of the parts within the principles of the present disclosure up to, and including the full extent established by the broad general meaning of the terms used in the claims. It will therefore be appreciated that the embodiments described above can be modified within the scope of the claims.

What is claimed is:

1. A fan assembly, comprising:

a first fan including a first frame having a first jointing surface;

a second fan including a second frame having a second jointing surface;

each of the first fan and the second fan having a first diagonal direction defined thereto and a second diagonal direction;

wherein, the first jointing surface of the first fan having two ends, the two ends defining a first concave structure and a first flange respectively;

wherein the second jointing surface of the second fan having two ends, the two ends defining a first concave structure and a first flange respectively; and wherein the first flange of the first fan is configured to be received by the first concave structure of the second fan, and the first flange of the second fan is configured to be received by the concave structure of the first fan; and wherein an elastic cantilever and a buckle hole are respectively formed on the first jointing surface of the first fan, and also an elastic cantilever and a buckle hole are formed on the second jointing surface of the second fan, a distal end of each elastic cantilever forms a block protruded beyond the first jointing surface and the second jointing surface, the first concave structure of the first fan includes a fourth flange and an engagement part extended from the fourth flange, a slot is defined between an inner side of the engagement part and the fourth flange, the engagement part of the first fan includes a connecting portion extended from the fourth flange, and a supporting portion extended horizontally from the connecting portion, a first groove is defined on the supporting portion, and connects with the slot, a convex block is extended from the first flange of the second fan, the convex block is received in the first groove, a gap is defined on the first flange of the second fan, the first flange extends in the gap to form the convex block.

2. The fan assembly of claim 1, wherein the block of the elastic cantilever of the first fan is clipped in the buckle hole of the second fan, and the block of the elastic cantilever of the second fan is clipped in the buckle hole of the first fan.

3. The fan assembly of claim 1, wherein a second groove is defined on the fourth flange, and is relative to the first groove, the fourth flange extends horizontally in the second groove to form the elastic cantilever.

4. The fan assembly of claim 3, wherein the distal end of the elastic cantilever extends towards the engagement part to form block.

5. The fan assembly of claim 1, wherein the first concave structure of each fan has the same structure with the second concave structure of the second fan.

6. The fan assembly of claim 1, wherein a second flange and a third flange are formed along two ends of the second direction of the first jointing surface of the first fan, two second concave structures are formed along two ends of the second direction of the second jointing surface of the second fan, the second flange and the third flange move relatively to the second jointing surface of the second fan, and are embedded in the second concave structure of the second fan.

* * * * *